US008169160B2

(12) United States Patent
Yan et al.

(10) Patent No.: US 8,169,160 B2
(45) Date of Patent: May 1, 2012

(54) CIRCUITS AND METHODS FOR DRIVING LIGHT SOURCES

(75) Inventors: Tiesheng Yan, Chengdu (CN); Ching-Chuan Kuo, Taipei (TW); Zhimou Ren, Chengdu (CN); Jun Ren, Chengdu (CN)

(73) Assignee: 02Micro, Inc, Santa Clara, CA (US)

( * ) Notice: Subject to any disclaimer, the term of this patent is extended or adjusted under 35 U.S.C. 154(b) by 0 days.

(21) Appl. No.: 12/967,933

(22) Filed: Dec. 14, 2010

(65) Prior Publication Data

US 2011/0080119 A1 Apr. 7, 2011

(30) Foreign Application Priority Data

Nov. 15, 2010 (CN) ..... 2010 1 0548415

(51) Int. Cl.

| | |
|---|---|
| ***H05B 37/02*** | (2006.01) |
| ***H05B 39/04*** | (2006.01) |
| ***H05B 41/36*** | (2006.01) |
| *H05B 37/00* | (2006.01) |
| *H05B 39/00* | (2006.01) |
| *H05B 41/00* | (2006.01) |

(52) U.S. Cl. ..... 315/307; 315/209 R; 315/291; 315/294; 315/297; 315/312

(58) Field of Classification Search ..... None
See application file for complete search history.

(56) References Cited

U.S. PATENT DOCUMENTS

| | | | | |
|---|---|---|---|---|
| 7,538,498 | B2 | 5/2009 | Hur et al. | |
| 2006/0055660 | A1 | 3/2006 | Teranishi | |
| 2008/0258632 | A1 | 10/2008 | Lee et al. | |
| 2009/0021471 | A1 | 1/2009 | Park et al. | |
| 2009/0273290 | A1 * | 11/2009 | Ziegenfuss | 315/193 |

FOREIGN PATENT DOCUMENTS

| | | | |
|---|---|---|---|
| CN | 101178880 | A | 5/2008 |
| CN | 101291557 | A | 10/2008 |
| CN | 100430973 | C | 11/2008 |
| JP | 2003143372 | A | 5/2003 |
| WO | 02061330 | A2 | 8/2002 |

OTHER PUBLICATIONS

English translation of Abstract for JP3815604B2.

* cited by examiner

*Primary Examiner* — Douglas W Owens
*Assistant Examiner* — Dedei K Hammond

(57) ABSTRACT

A circuit for driving a light source, e.g., an LED light source, includes a converter, a sensor, and a controller. The converter converts an input voltage to an output voltage across the LED light source based upon a driving signal. A duty cycle of the driving signal determines an average current flowing through the LED light source. The sensor is selectively coupled to and decoupled from the converter based upon the driving signal. The sensor generates a sense voltage indicative of a current flowing through the LED light source when the sensor is coupled to the converter. The controller is coupled to the converter and sensor. The controller compares the sense voltage to a reference voltage indicative of a predetermined average current through the LED light source to generate a compensation signal and generates the driving signal based upon the compensation signal. The duty cycle of the driving signal is adjusted based upon the compensation signal to adjust the average current flowing through the LED light source to the predetermined average current.

15 Claims, 8 Drawing Sheets

CIRCUITS AND METHODS FOR DRIVING LIGHT SOURCES

RELATED APPLICATION

This application claims priority to Patent Application No. 201010548415.4, titled "Driving Circuit for Light Source, and Controller and Method for Controlling Luminance of Light Source", filed on Nov. 15, 2010, with the State Intellectual Property Office of the People's Republic of China.

BACKGROUND

Light sources such as light emitting diodes (LEDs) can be used, e.g., for backlighting liquid crystal displays (LCDs), street lighting, and home appliances. LEDs offer several advantages over alternative light sources. Among these are greater efficiency and increased operating life.

FIG. 1 shows a schematic diagram of a conventional circuit 100 for driving a light source, e.g., an LED string. FIG. 2 shows a waveform 200 of a current flowing through the LED string in FIG. 1. As shown in FIG. 1, the circuit 100 for driving an LED string 108 includes a power source 102, a rectifier 104, a capacitor 106, a controller 110, and a buck converter 111. The power source 102 provides an input alternating-current (AC) voltage. The rectifier 104 and the capacitor 106 converts the input AC voltage to an input direct-current (DC) voltage $V_{IN}$.

Controlled by the controller 110, the buck converter 111 further converts the input DC voltage $V_{IN}$ to an output DC voltage $V_{OUT}$ across the LED string 108. Based on the output DC voltage $V_{OUT}$, the circuit 100 produces an LED current $I_{LED}$ flowing through the LED string 108. The buck converter 111 includes a diode 106, an inductor 118, and a switch 112. The switch 112 includes an N-channel transistor as shown in FIG. 1. The controller 110 is coupled to the gate of the switch 112 via a DRV pin and coupled to the source of the switch 112 via a CS pin. A resistor 114 is coupled between the CS pin and ground to produce a sense voltage indicative of the LED current $I_{LED}$. The switch 112 controlled by the controller 110 is turned on and off alternately.

Referring to FIG. 2, when the switch 112 is in an ON state, the LED current $I_{LED}$ ramps up and flows through the inductor 118, the switch 112 and the resistor 114 to ground. The controller 110 receives the sense voltage indicative of the LED current $I_{LED}$ via the CS pin and turns off the switch 112 when the LED current $I_{LED}$ reaches a peak LED current $I_{PEAK}$. When the switch 112 is in an OFF state, the LED current $I_{LED}$ ramps down from the peak LED current $I_{PEAK}$ and flows through the inductor 118 and the diode 106.

The controller 110 can operate in a constant period mode or a constant off time mode. In the constant period mode, the controller 110 turns the switch 112 on and off alternately and maintains a cycle period Ts of the control signal from pin DRV substantially constant. An average value $I_{AVG}$ of the LED current $I_{LED}$ can be given by:

$$I_{AVG} = I_{PEAK} - \frac{1}{2} \cdot \frac{(V_{IN} - V_{OUT}) \times \frac{V_{OUT}}{V_{IN}} \times T_S}{L}, \quad (1)$$

where L is the inductance of the inductor 118. In the constant off time mode, the controller 110 turns the switch 112 on and off alternately and maintains an off time $T_{OFF}$ of the switch 112 substantially constant. The average value $I_{AVG}$ of the LED current $I_{LED}$ can be given by:

$$I_{AVG} = I_{PEAK} - \frac{1}{2} \cdot \frac{V_{OUT} \times T_{OFF}}{L}. \quad (2)$$

According to equations (1) and (2), the average LED current $I_{AVG}$ is functionally dependent on the input DC voltage $V_{IN}$, the output DC voltage $V_{OUT}$ and the inductance of the inductor 118. In other words, the average LED current $I_{AVG}$ varies as the input DC voltage $V_{IN}$, the output DC voltage $V_{OUT}$ and the inductance of the inductor 118 change. Therefore, the LED current $I_{LED}$ may not be accurately controlled, thereby affecting the stability of LED brightness.

SUMMARY

In one embodiment, a circuit for driving a light source, e.g., an LED light source, includes a converter, a sensor, and a controller. The converter converts an input voltage to an output voltage across the LED light source based upon a driving signal. A duty cycle of the driving signal determines an average current flowing through the LED light source. The sensor is selectively coupled to and decoupled from the converter based upon the driving signal. The sensor generates a sense voltage indicative of a current flowing through the LED light source when the sensor is coupled to the converter. The controller is coupled to the converter and sensor. The controller compares the sense voltage to a reference voltage indicative of a predetermined average current through the LED light source to generate a compensation signal and generates the driving signal based upon the compensation signal. The duty cycle of the driving signal is adjusted based upon the compensation signal to adjust the average current flowing through the LED light source to the predetermined average current.

BRIEF DESCRIPTION OF THE DRAWINGS

Features and advantages of embodiments of the claimed subject matter will become apparent as the following detailed description proceeds, and upon reference to the drawings, wherein like numerals depict like parts, and in which:

DETAILED DESCRIPTION

Reference will now be made in detail to the embodiments of the present invention. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

Embodiments in accordance with the present disclosure provide a driving circuit for driving a light source. The driving circuit includes a converter, a sensor, and a controller. The converter converts an input voltage to an output voltage across the light source based upon a driving signal. A duty cycle of the driving signal determines an average current flowing through the light source. The sensor is selectively coupled to and decoupled from the converter based upon the driving signal. The sensor generates a sense voltage indicative of a current flowing through the light source when the sensor is coupled to the converter. The controller is coupled to the converter and sensor. The controller compares the sense voltage to a reference voltage indicative of a predetermined average current through the light source to generate a compensation signal and generates the driving signal based upon the compensation signal. The duty cycle of the driving signal is adjusted based upon the compensation signal to adjust the average current flowing through the light source to the predetermined average current.

Figure 1:
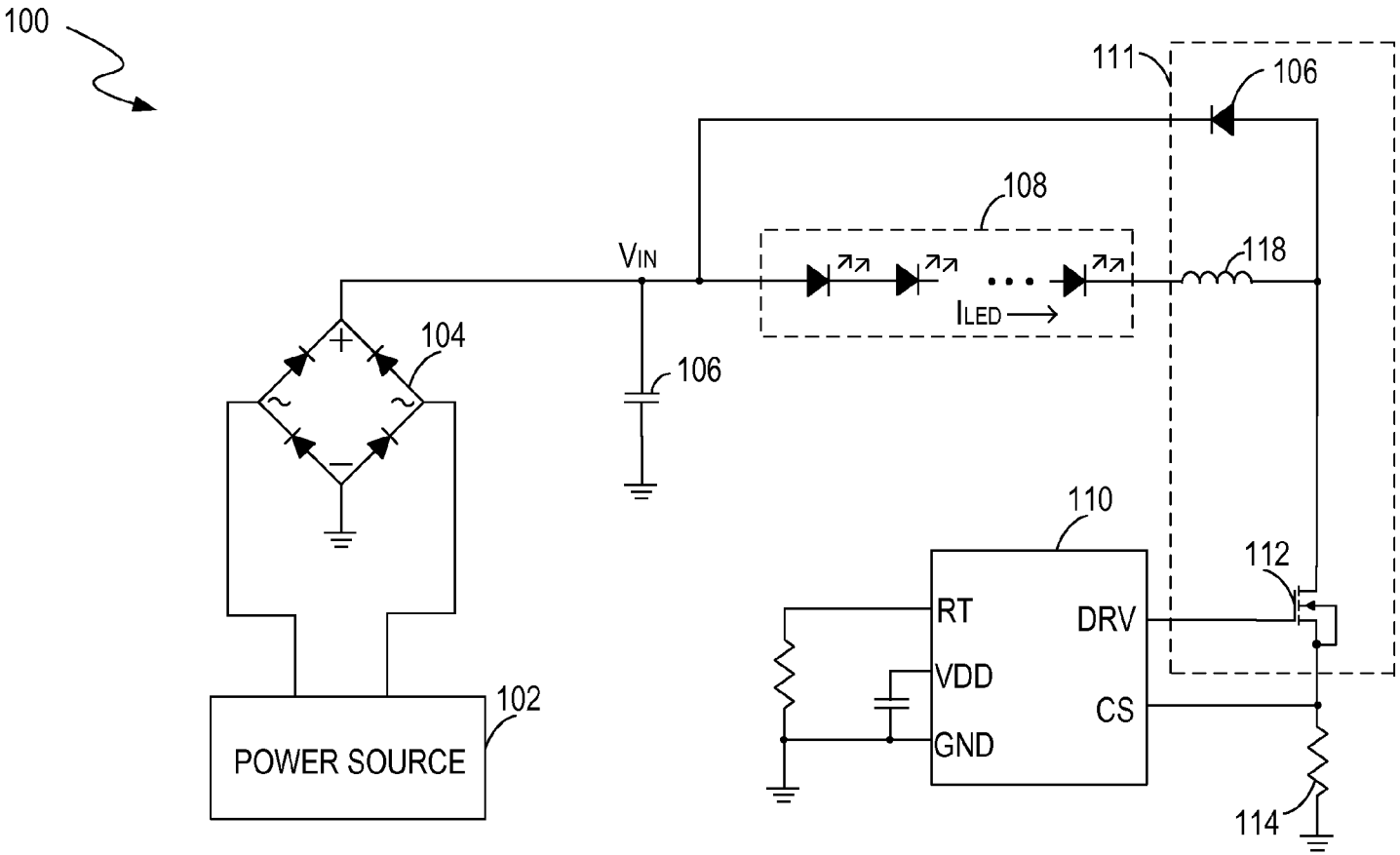
FIG. 1 PRIOR ART
FIG. 1 is a schematic diagram of a conventional circuit for driving a light source.
Figure 2:
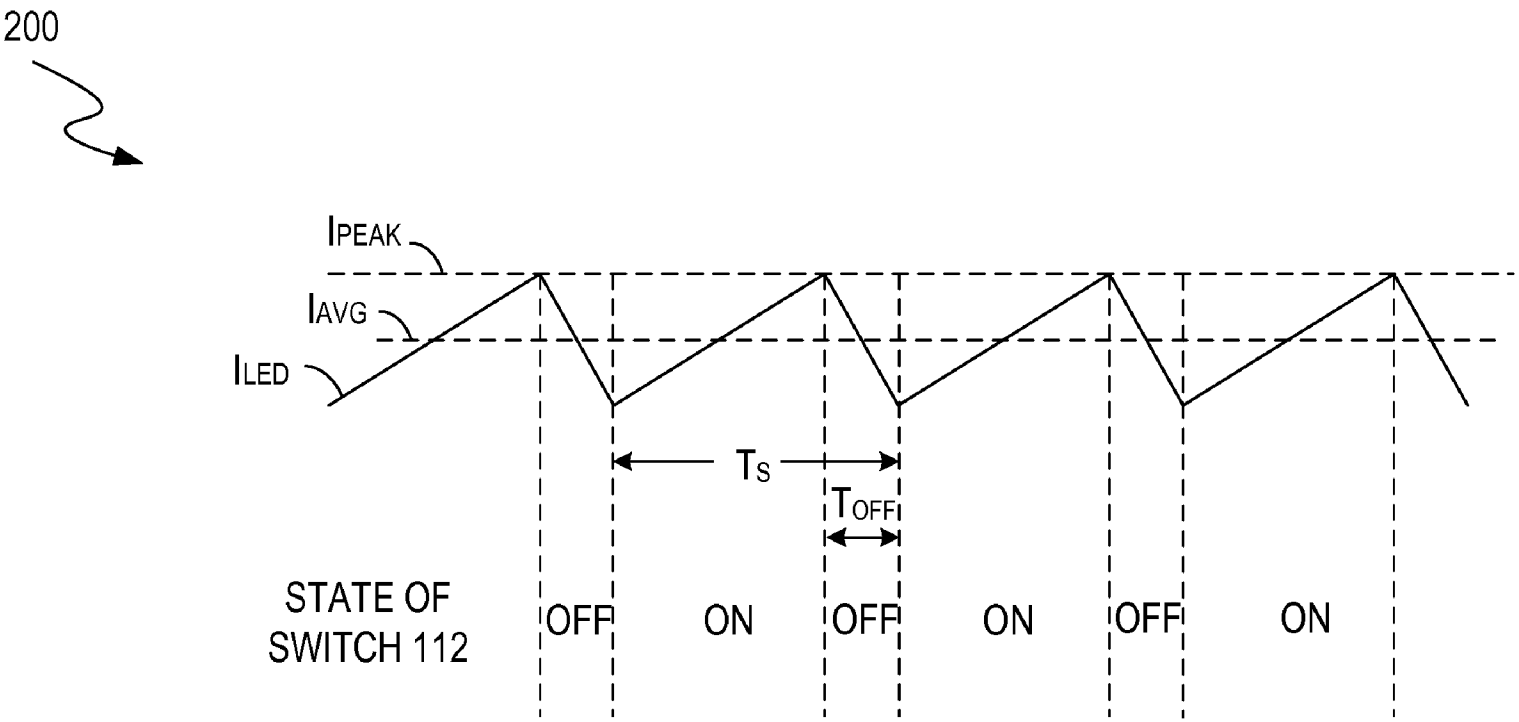
FIG. 2 PRIOR ART
FIG. 2 is a waveform of a current flowing though the light source in FIG. 1.
Figure 3:
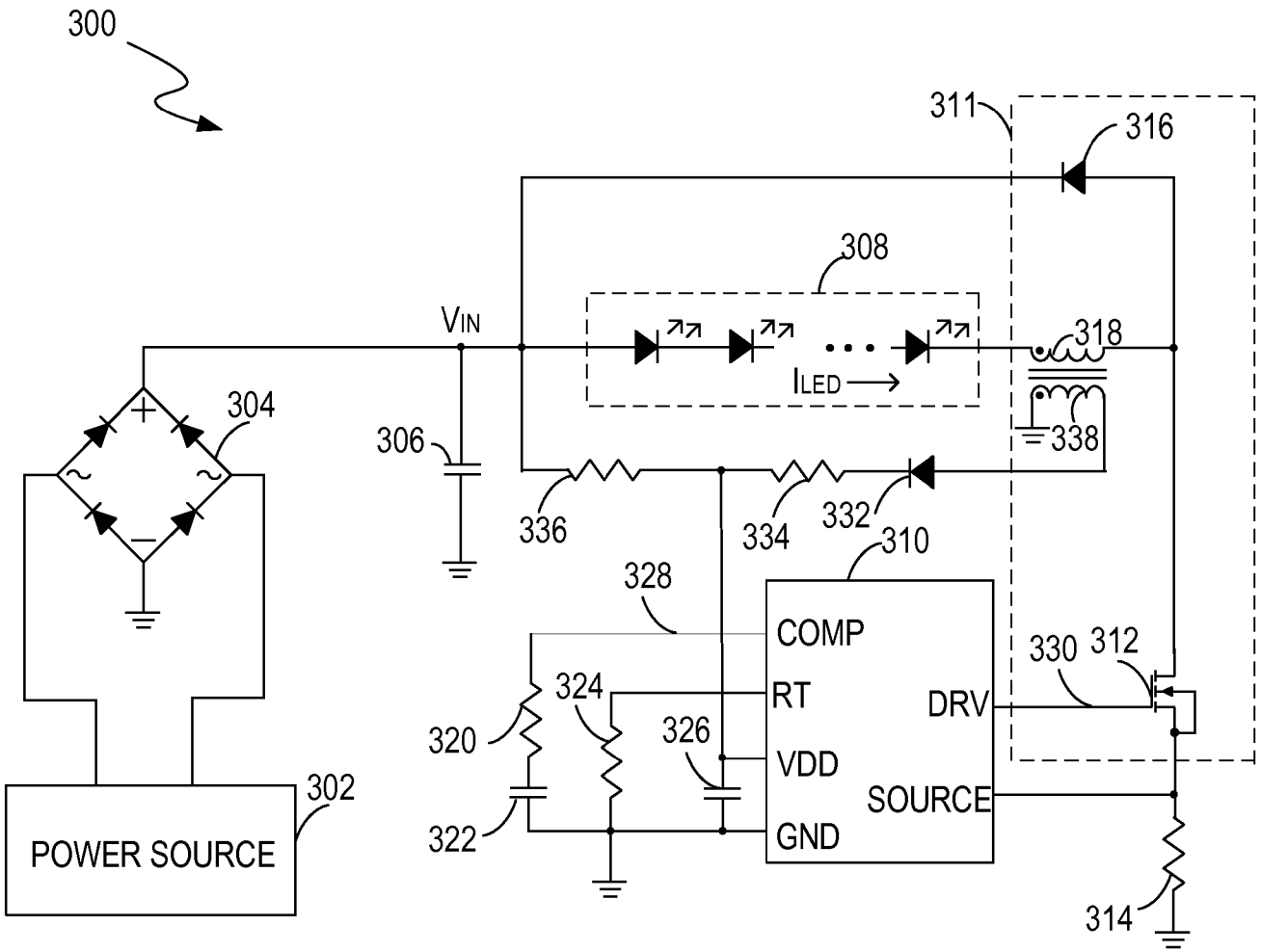
FIG. 3 is a schematic diagram of a driving circuit according to one embodiment of the present invention.

FIG. 3 illustrates a driving circuit 300 according to one embodiment of the present invention. In the example of FIG. 3, the driving circuit 300 includes a power source 302, a rectifier 304, a capacitor 306, a converter 311, a controller 310, and a sensor, e.g., a resistor 314. The driving circuit 300 is coupled to one or more light sources, e.g., an LED string 308, for controlling the brightness of the light sources. In one embodiment, the power source 302 provides an AC voltage, and the rectifier 304 and the capacitor 306 convert the AC voltage to an input DC voltage $V_{IN}$. The input DC voltage $V_{IN}$ is further converted to an output DC voltage $V_{OUT}$ across the LED string 308 by the converter 311 which includes a diode 316, a switch 312, and an inductor 318, in one embodiment. According to states of the switch 312 and the diode 316, the converter 311 alternates between coupling the inductor 318 to the input DC voltage $V_{IN}$ to store energy into the inductor 318 and discharging the inductor 318 to the LED string 308. For a given input DC voltage $V_{IN}$, the output DC voltage $V_{OUT}$ is determined by a duty cycle D of the switch 312, that is, a ratio between a period $T_{ON}$ when the switch 312 is on (ON state) and the commutation period $T_S$.

The duty cycle D of the switch 312 is controlled by the controller 310. In one embodiment, the controller 310 includes a COMP pin, a RT pin, a VDD pin, a GND pin, a DRV pin, and a SOURCE pin. The switch 312 includes an N-channel transistor, in one embodiment. The gate of the transistor 312 is coupled to the DRV pin of the controller 310. The source of the transistor 312 is coupled to the SOURCE pin of the controller 310. The source of the transistor 312 together with the SOURCE pin of the controller 310 is also coupled to ground through the resistor 314. The COMP pin of the controller 310 is coupled to ground through serially connected resistor 320 and an energy storage element, e.g., a capacitor 322. The RT pin is coupled to ground through a resistor 324. VDD pin is coupled to ground through a capacitor 326, coupled to the input DC voltage $V_{IN}$ through a resistor 336, and coupled to a winding 338 through a diode 332 and a resistor 334. The winding 338 is magnetically coupled to the inductor 318. A startup voltage is produced at the VDD pin to startup the controller 310. Alternatively, a voltage source (now shown) can be coupled to the VDD pin for providing the startup voltage.

In operation, the resistor 314 is selectively coupled to and decoupled from the converter 311 based upon the conduction state of the switch 312. When the switch 312 is in the ON state, an LED current $I_{LED}$ is produced to flow through a first current path including the LED string 308, the inductor 318, the switch 312 and the resistor 314. The voltage across the resistor 314 is indicative of the LED current $I_{LED}$ and received by the controller 310 via the SOURCE pin as a sense voltage. When the switch 312 is in an OFF state, the LED current $I_{LED}$ is produced to flow through a second path including the LED string 308, the inductor 318 and the diode 316. No current flows through the switch 312 and the resistor 314. Accordingly, the sense voltage at the SOURCE pin is substantially zero, in one embodiment.

In one embodiment, the controller 310 compares the sense voltage to a reference voltage $V_{REF}$ indicative of a predetermined average LED current $I_{AVG0}$ to generate a compensation signal 328 at the COMP pin. Based upon the compensation signal 328, the controller 310 generates a driving signal 330 at the DRV pin to turn the switch 312 on and off alternately and adjusts a duty cycle D of the driving signal 330. As such, the average LED current $I_{AVG}$ through the LED string 308 is adjusted to the predetermined average LED current $I_{AVG0}$ by adjusting the duty cycle D of the driving signal 330. The average LED current $I_{AVG}$ is not functionally dependent on the input DC voltage $V_{IN}$, the output DC voltage $V_{OUT}$ or the inductance L. Advantageously, by introducing the compensation signal 328, the impact of the input DC voltage $V_{IN}$, the output DC voltage $V_{OUT}$ and the inductance L on the average LED current $I_{AVG}$ is reduced or eliminated, such that the stability of LED brightness is improved.

Figure 4:
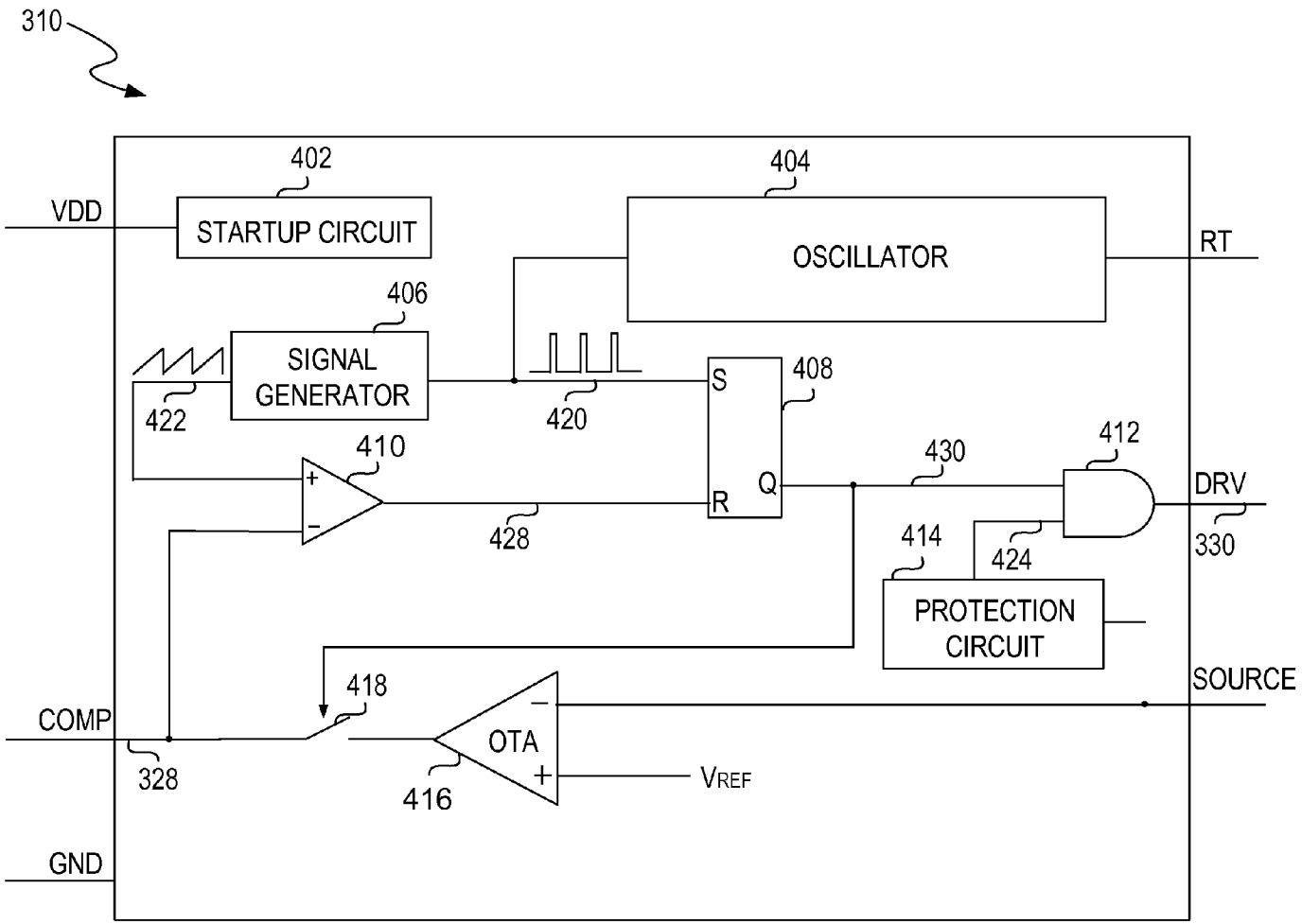
FIG. 4 is a schematic diagram of a controller in FIG. 3 according to one embodiment of the present invention.

FIG. 4 illustrates a schematic diagram of the controller 310 in FIG. 3 according to one embodiment of the present invention. Elements labeled the same in FIG. 3 have similar functions. FIG. 4 is described in combination with FIG. 3. In the example of FIG. 4, the controller 310 includes a startup circuit 402, an oscillator 404, a signal generator 406, a flip-flop 408, a comparator 410, an output circuit, e.g., an AND gate 412, a protection circuit 414, an amplifier, e.g., an operational transconductance amplifier (OTA) 416, and a control switch 418. The OTA 416, the control switch 418, and the comparator 410 constitute a feedback circuit.

The startup circuit 402 receives the startup voltage via the VDD pin. When the startup voltage at the VDD pin reaches a predetermined startup voltage level of the controller 310, the startup circuit 420 provides power to other components in the controller 310 to enable operation of the controller 310. The oscillator 404 generates a pulse signal 420 which has a preset frequency determined by the resistor 324, in one embodiment. The flip-flop 408 receives the pulse signal 420 via a set pin S. The pulse signal 420 is further provided to the signal generator 406 which generates a ramp signal 422 having the same frequency as the pulse signal 420. In one embodiment, the ramp signal 422 has a sawtooth wave. As mentioned in relation to FIG. 3, the SOURCE pin of the controller 310 is coupled to the resistor 314 to receive the sense voltage indicating the LED current $I_{LED}$. The sense voltage is provided to the protection circuit 414 which outputs a protection signal 424 to the AND gate 412 to indicate whether the driving circuit 300 is in a normal condition or an abnormal condition, e.g., a short circuit condition or an over current condition.

Moreover, the sense voltage is provided to an input terminal, e.g., an inverting terminal, of the OTA 416. The other input terminal, e.g., a non-inverting terminal of the OTA 416 receives the reference voltage $V_{REF}$ indicative of the predetermined average LED current $I_{AVG0}$. The OTA 416 outputs a current which is a function of the differential input voltage. In one embodiment, the output current is proportional to the voltage difference between the sense voltage and the reference voltage $V_{REF}$. The output current charges the capacitor 322 via a charging path including the control switch 418 and the resistor 320 to produce the compensation signal 328 at the COMP pin. The compensation signal 328 is provided to an input terminal, e.g., an inverting terminal, of the comparator 410. The comparator 410 compares the compensation signal 328 to the ramp signal 422 to output a reset signal 428 to a reset pin R of the flip-flop 408. In one embodiment, the reset signal 428 comprises a pulse-width modulation signal (PWM) signal. Triggered by the pulse signal 420 and the reset signal 428, the flip-flop 408 outputs a control signal 430 via an output pin Q. The control signal 430 is further provided to both the AND gate 412 and the control switch 418, in one embodiment.

Thus, the AND gate 412 receives the control signal 430 and the protection signal 424. As such, when an abnormal condition occurs as indicated by the protection signal 424, the driving signal 330 from the AND gate 412 switches the switch 312 off to prevent the driving circuit 300 from undergoing abnormal conditions. When the driving circuit 300 operates in the normal condition, the driving signal 330 is determined by the control signal 430 to alternate the switch 312 between the ON state and OFF state. In other words, the waveform of the driving signal 300 follows that of the control signal 430 when the driving circuit 300 operates in the normal condition, in one embodiment. As such, the state of the control switch 418 is synchronized with the state of the switch 312. Referring to FIG. 3, when the switch 312 is off, the charging path of the capacitor 322 is cut off accordingly such that the compensation signal 328 is clamped to a non-zero value. When the switch 312 is on, the charging path of the capacitor 322 is conductive and the controller 310 senses the sense voltage via the SOURCE pin to produce the compensation signal 328. Based on the compensation signal 328, the driving signal 330 at DRV pin drives the switch 312 such that the average LED current $I_{AVG}$ through the LED string 308 is adjusted to the predetermined average LED current $I_{AVG0}$.

Advantageously, in one embodiment, the predetermined average LED current $I_{AVG0}$ is determined by the predetermined reference voltage $V_{REF}$ independent of various circuit conditions, such as the input DC voltage $V_{IN}$, the load condition, and the inductor 318. As such, brightness stability of the light sources is improved.

Figure 5:
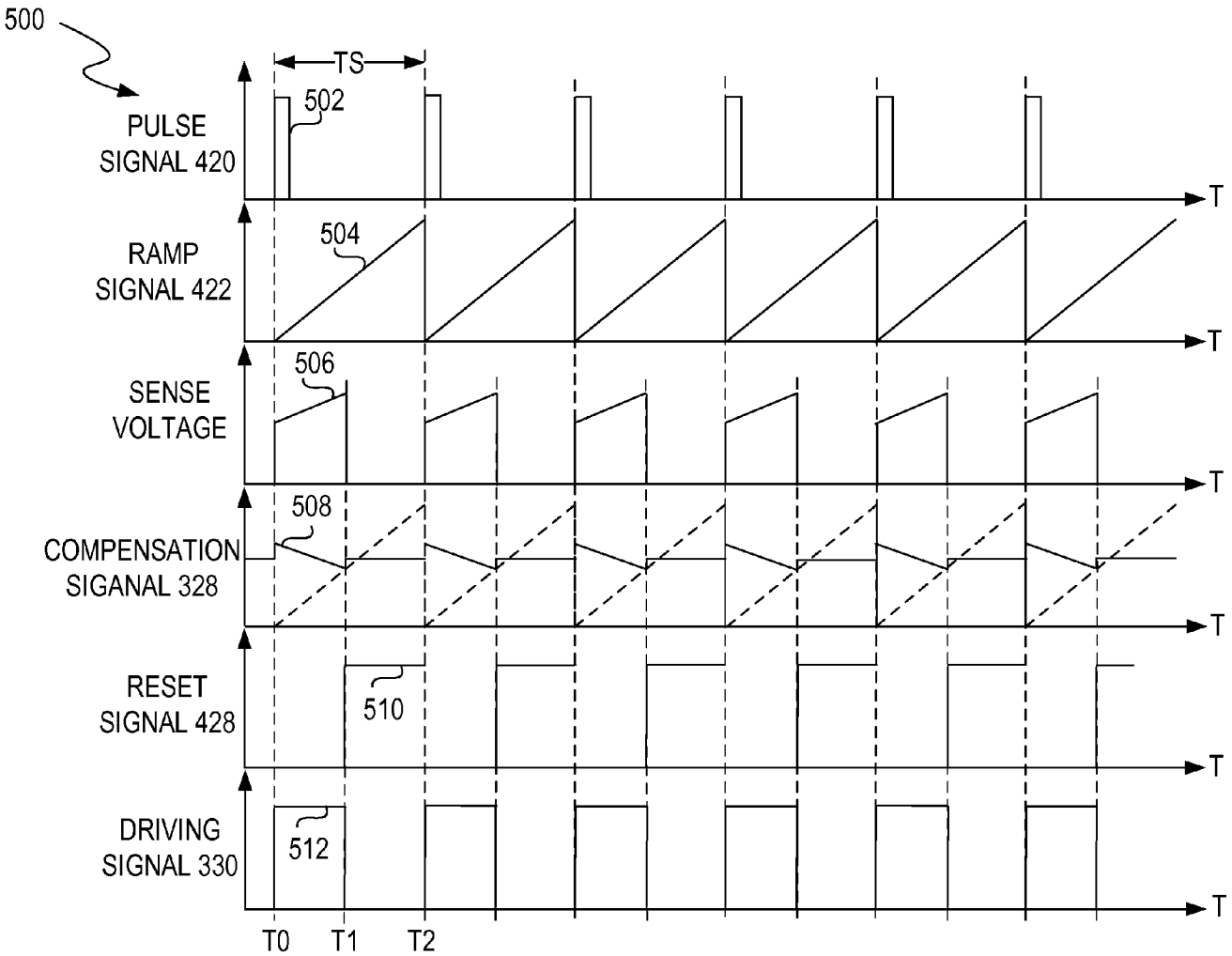
FIG. 5 is a timing diagram of the driving circuit in FIG. 3 according to one embodiment of the present invention.

FIG. 5 illustrates a timing diagram 500 of the driving circuit 300 FIG. 3 according to one embodiment of the present invention. FIG. 5 is described in combination with FIGS. 3 and 4. The waveform 502 represents the pulse signal 420. The waveform 504 represents the ramp signal 422, the waveform 506 represents the sense voltage at the SOURCE pin, the waveform 508 represents the compensation signal 328 at the COMP pin, the waveform 510 represents the reset signal 428, and the waveform 512 represents the driving signal 330 at the DRV pin.

In the example of FIG. 5, when the pulse signal 420 steps from a low level (logic 0) to a high level (logic 1) and the ramp signal 422 begins to ramp up at time T0, the driving signal 330 is set to logic 1 to switch on the switch 312. The sense voltage at the SOURCE pin increases as the LED current $I_{LED}$ flowing through the resistor 314 increases. With the increase of the sense voltage, the output current of the OTA 416 decrease, so does the compensation signal 328. The compensation signal 328 decreases until the compensation signal 328 intersects with the ramp signal 422 at time T1. Due to the intersection of compensation signal 328 with the ramp signal 422 at time T1, the reset signal 428 output from the comparator 410 steps from logic 0 to logic 1 and the driving signal 330 is set to logic 0 to switch off the switch 312.

Since the switch 312 is turned off, no current flows through the resistor 314 such that the sense voltage at the SOURCE pin drops to substantially zero at time T1. As discussed in relation to FIG. 4, the control switch 418 is turned off together with the switch 312, such that the charging path of the capacitor 322 is cut off and the compensation signal 328 is clamped to the non-zero value at time T1. In a commutation period $T_S$ of the pulse signal 420 after time T0, e.g., at time T2, the pulse signal 420 steps from logic 0 to logic 1 to assert a new pulse while the ramp signal 422 having the same frequency as the pulse signal 420 drops sharply and becomes lower than the compensation signal 328 which is clamped to a non-zero value. The reset signal 428 is set to logic 0 and the drive signal 330 is set to logic 1 again at time T2. As such, a commutation cycle from time T0 to time T2 completes. A new commutation cycle starts from time T2.

As shown in FIG. 5, the duty cycle D of the driving signal 330 is determined by the compensation signal 328 indicative of the difference between the sense voltage at the SOURCE pin and the reference voltage $V_{REF}$. The duty cycle D of the driving signal 330 is used to regulate the average LED current $I_{AVG}$ to the predetermined average LED current $I_{AVG0}$ indicated by the reference voltage $V_{REF}$. In other words, a feedback loop is formed where the sense voltage is fed back to the controller 310 and compared to the reference voltage $V_{REF}$ and the difference between the sense voltage and the reference voltage is used to generate the compensation signal 328 to regulate the average LED current $I_{AVG}$ to the predetermined average LED current $I_{AVG0}$. As such, even if the circuit condition of the circuit 300 changes, the duty cycle D of the driving signal 330 changes dynamically due to the feedback loop to keep the average LED current $I_{AVG}$ substantially equal to the predetermined average LED current $I_{AVG0}$.

For example, when the input DC voltage $V_{IN}$ increases, the instant LED current $I_{LED}$ increases and the instant sense voltage at the SOURCE pin increases accordingly. With the increased sense voltage, the compensation signal 328 decreases such that the duty cycle D of the driving signal 330 is reduced. As the duty cycle D of the driving signal 330 decreases, the LED current $I_{LED}$ decreases accordingly such that the effect of the increased input DC voltage $V_{IN}$ is canceled out by the reduced duty cycle D of the driving signal 330 to maintain the average LED current $I_{AVG}$ substantially equal to the predetermined average LED current $I_{AVG0}$. Similarly, when other circuit condition changes, e.g., the load condition and the inductor 318, the average LED current $I_{AVG}$ is kept substantially equal to the predetermined average LED current $I_{AVG0}$ due to the dynamic adjustment of the duty cycle D of the driving signal 330.

Figure 6:
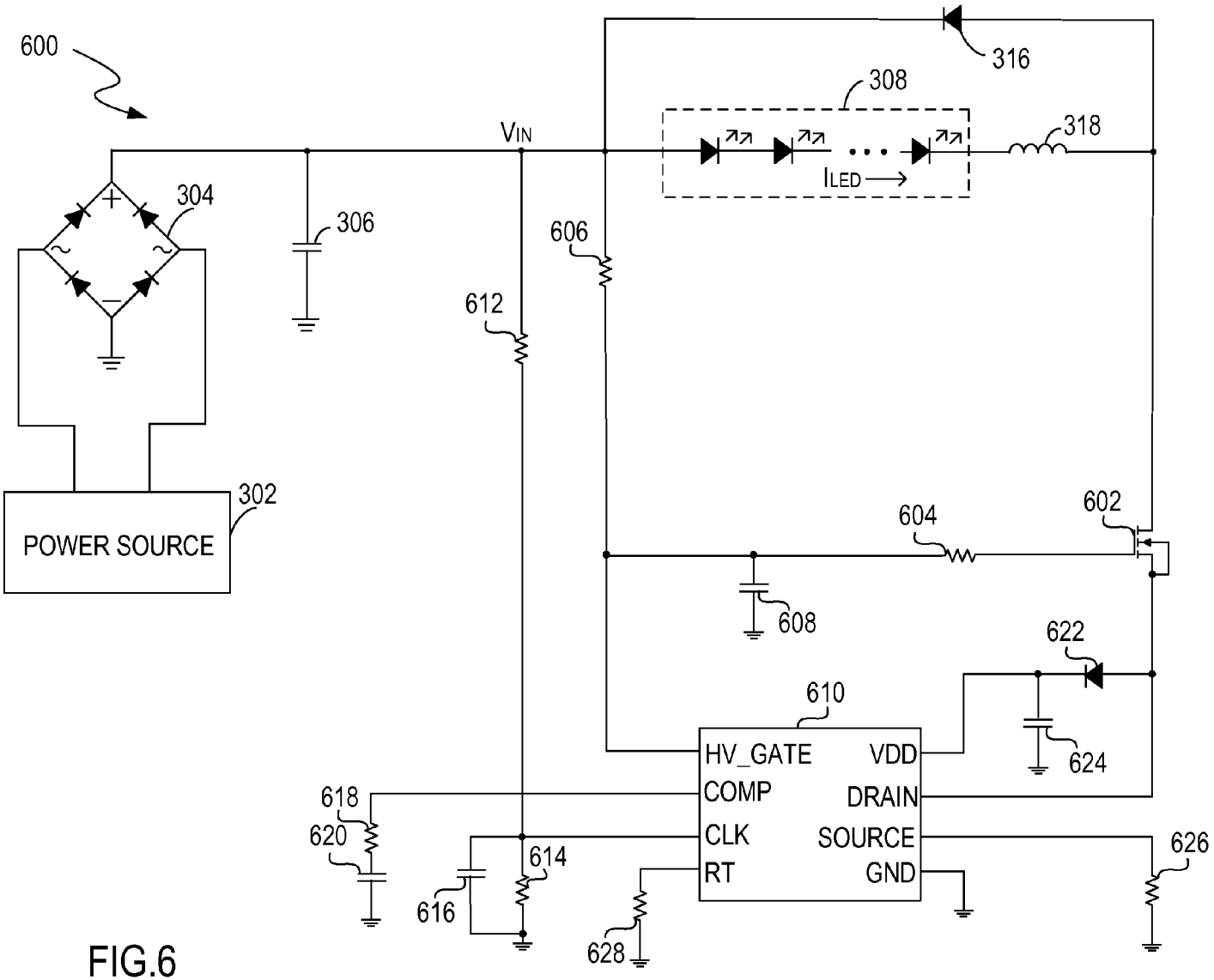
FIG. 6 is a schematic diagram of a driving circuit according to another embodiment of the present invention.

FIG. 6 illustrates a schematic diagram of a driving circuit 600 according to another embodiment of the present invention. Elements labeled the same in FIG. 3 have similar functions. Besides the power source 302, the rectifier 304, the capacitor 306, the diode 316 and the inductor 318, the driving circuit 600 further includes a controller 610 having a VDD pin, a DRAIN pin, a SOURCE pin, a GND pin, a HV_GATE pin, a COMP pin, a CLK pin and a RT pin. The HV_GATE pin is coupled to the input DC voltage $V_{IN}$ through a resistor 606 and coupled to ground through a capacitor 608. The COMP pin is coupled to ground through serially connected resistor 618 and an energy storage element, e.g., a capacitor 620. The CLK pin is coupled to ground through parallel connected resistor 614 and capacitor 616. The CLK pin is also coupled to input DC voltage $V_{IN}$ through a resistor 612. The RT pin is coupled to ground through a resistor 628. The VDD pin is coupled to the HV_GATE pin through serially connected resistor 604, switch 602 and diode 622. In one embodiment, the switch 602 includes an N-channel transistor, with gate coupled to the resistor 604, source coupled to anode of the diode 622, and drain coupled to the inductor 318. The VDD pin is also coupled to ground through a capacitor 624. The DRAIN pin is coupled to source of the switch 602. The SOURCE pin is coupled to ground through a resistor 626. The GND pin is coupled to ground.

Different from the driving circuit 300 where the switch 312 for alternating the inductor 318 between charging and discharging is located outside the controller 310, the controller 610 in the driving circuit 600 has the function of alternating the inductor 318 between charging and discharging.

Figure 7:
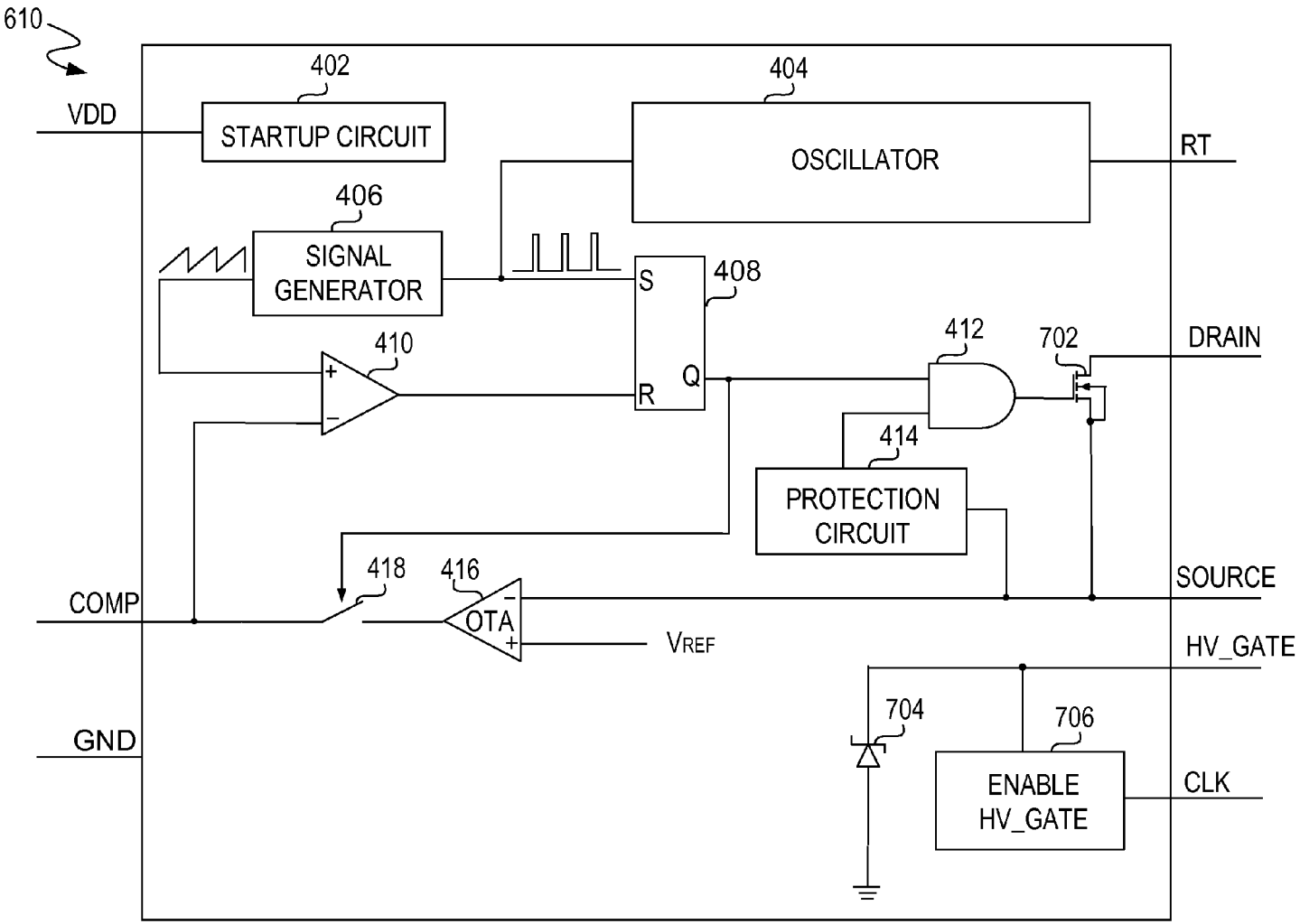
FIG. 7 is a schematic diagram of a controller in FIG. 6 according to one embodiment of the present invention.

FIG. 7 illustrates a schematic diagram of the controller 610 according to one embodiment of the present invention. Elements labeled the same in FIG. 4 have similar functions. FIG. 7 is described in combination with FIGS. 4 and 6. In the example of FIG. 7, the controller 610 includes the startup circuit 402, the oscillator 404, the signal generator 406, the flip-flop 408, the comparator 410, the AND gate 412, the protection circuit 414, the OTA 416, the switch 418, a switch 702, a zener diode 704, and an enbable HV_GATE block 706. The switch 702 alternates the inductor 318 between charging and discharging. When the switch 702 is in the ON state, the LED current $I_{LED}$ flows through the LED string 308, the inductor 318, the switch 602, the switch 702 and the resistor 626 to ground. When the switch 702 is in the OFF state, the LED current flows through the LED string 308, the inductor 318 and the diode 316. As such, the SOURCE pin produces the sense voltage indicative of the LED current $I_{LED}$ when the switch 702 is in the ON state.

In one embodiment, the switch 702 includes an N-channel transistor, with gate coupled to the AND gate 412, drain coupled to the DRAIN pin, and source coupled to the SOURCE pin. The zener diode 704 is coupled between the HV_GATE pin and ground. The enable HV_GATE block 706 is coupled between the CLK pin and the HV_GATE pin. When the driving circuit 600 is powered on, an enable signal is produced at the CLK pin in response to the input DC voltage $V_{IN}$. In response to the enable signal, the enable HV_GATE block 706 activates the HV_GATE pin to produces a constant DC voltage, e.g., 15V, determined by the zener diode 704. Driven by the constant DC voltage at the HV_GATE pin, the switch 602 is switched on. The VDD pin obtains a startup voltage derived from a source voltage at the source of the switch 602. The startup voltage enables the operation of the controller 610. The sense voltage at the SOURCE pin is fed back and compared to the reference voltage $V_{REF}$ indicative of the predetermined average LED current $I_{AVG0}$ to generate the compensation signal 328. Based on the compensation signal 328, the duty cycle D of the driving signal 330 is determined. The driving signal 330 having the determined duty cycle D switches the switch 702 on and off alternately to adjust the average LED current $I_{AVG}$ to the predetermined average LED current $I_{AVG0}$.

With the configuration of FIGS. 6 and 7, the controller 610 operates automatically due to the enable signal at the CLK pin, the constant DC voltage at the HV_GATE pin, and the startup voltage at the VDD pin, when the driving circuit 600 is powered on. In normal operation, the DRAIN pin receives the LED current $I_{LED}$, the SOURCE pin alternates between coupling to and decoupling from the DRAIN pin based upon the driving signal 330. The duty cycle D of the driving signal 330 determines the average LED current $I_{AVG}$. The COMP pin generates the compensation signal 328 based upon the voltage difference between the sense voltage and the reference voltage $V_{REF}$. Based upon the compensation signal 328, the duty cycle D of the driving signal 330 is adjusted to the predetermined average LED current $I_{AVG0}$.

The embodiments of FIGS. 3, 4, 6 and 7 are for the purposes of illustration but not limitation. The exemplary circuits can have numerous variations within the spirit of the invention. For example, the OTA 416 can be replaced by an error amplifier or other similar elements as long as the compensation signal 328 can be produced to represent the voltage difference between the sense voltage and the reference voltage $V_{REF}$. Also, the inductor 318 can be placed between the input DC voltage $V_{IN}$ and the LED string 308.

Figure 8:
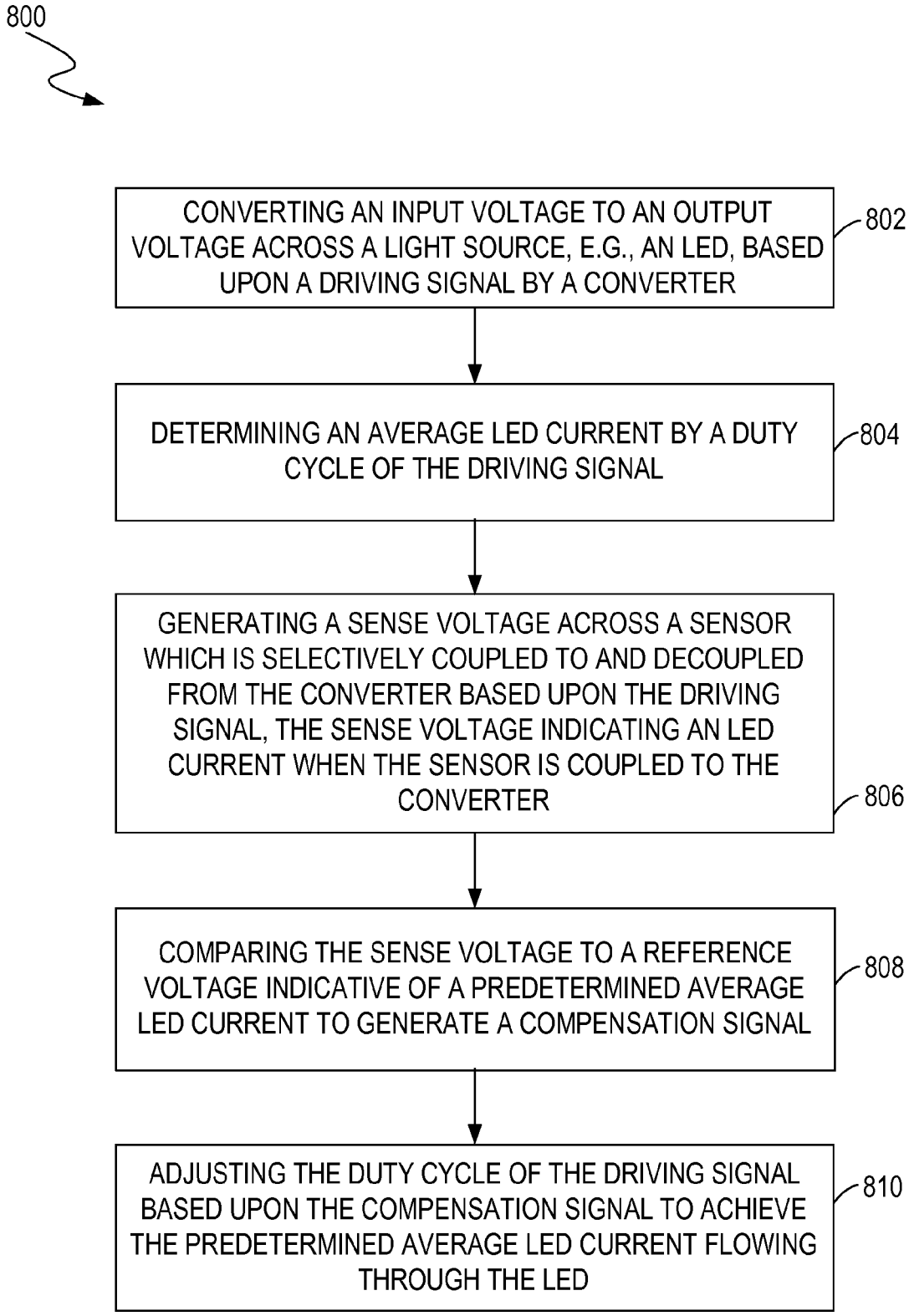
FIG. 8 is a flowchart of a method for controlling brightness of a light source according to one embodiment of the present invention.

FIG. 8 illustrates a flowchart 800 of a method for controlling brightness of a light source according to one embodiment of the present invention. FIG. 8 is described in combination with FIGS. 3 and 4. Although specific steps are disclosed in FIG. 8, such steps are examples. That is, the present invention is well suited to performing various other steps or variations of the steps recited in FIG. 8.

In block 802, an input voltage is converted to an output voltage across a light source, e.g., an LED light source, based upon a driving signal by a converter. In one embodiment, the converter 311 converts the input DC voltage $V_{IN}$ to the output DC voltage $V_{OUT}$ across the LED string 308 based upon the driving signal 330 from the DRV pin of the controller 310.

In block 804, an average LED current is determined by a duty cycle of the driving signal. In one embodiment, the duty cycle D of the driving signal 330 determines the conduction state of the switch 312 so as to adjust the average LED current $I_{AVG}$. In other words, the average LED current $I_{AVG}$ is determined by the duty cycle of the driving signal 330.

In block 806, a sense voltage indicative of the LED current is generated across a sensor when the sensor is coupled to the converter. The sensor is selectively coupled to and decoupled from the converter based upon the driving signal. In one embodiment, the voltage across a sensor, e.g., the resistor 314, indicates the LED current $I_{LED}$ when the switch 312 is in the ON state. The voltage across the resistor 314 is received by the controller 310 via the SOURCE pin as the sense voltage indicative of the LED current $I_{LED}$. When the switch 312 is in the OFF state, the resistor 314 is decoupled from the converter 311. The conduction state of the switch 312 is determined by the driving signal 330.

In block 808, the sense voltage is compared to a reference voltage indicative of a predetermined average LED current to generate a compensation signal. In one embodiment, the sense voltage is compared to the reference voltage indicative of the predetermined average LED current $I_{AVG0}$ by the OTA 416 to generate the compensation signal 328 at the COMP pin.

In block 810, the duty cycle of the driving signal is adjusted based upon the compensation signal to adjust the average LED current $I_{AVG}$ to the predetermined average LED current $I_{AVG0}$. In one embodiment, the compensation signal 328 is compared to a ramp signal 422 by the comparator 410. Output of the comparator 410 adjusts the duty cycle D of the driving signal 330 to adjust the average LED current $I_{AVG}$ to the predetermined average LED current $I_{AVG0}$.

While the foregoing description and drawings represent embodiments of the present invention, it will be understood that various additions, modifications and substitutions may be made therein without departing from the spirit and scope of the principles of the present invention. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, and not limited to the foregoing description.

What is claimed is:

1. A circuit for driving a light emitting diode (LED) light source, said circuit comprising:

a converter for converting an input voltage to an output voltage across said light source based upon a driving signal, wherein a duty cycle of said driving signal determines an average current flowing through said LED light source;

a sensor selectively coupled to and decoupled from said converter based upon said driving signal, and for generating a sense voltage indicative of a current flowing through said LED light source when said sensor is coupled to said converter; and a controller coupled to said converter and said sensor and for comparing said sense voltage to a reference voltage indicative of a predetermined average current through said LED light source to generate a compensation signal and for generating said driving signal based upon said compensation signal, wherein said duty cycle of said driving signal is adjusted based upon said compensation signal to adjust said average current flowing through said LED light source to said predetermined average current, wherein said controller further comprises a feedback circuit coupled to said sensor and for comparing said sense voltage to said reference voltage to generate said compensation signal and for outputting a reset signal by comparing said compensation signal to a ramp signal, wherein said feedback circuit further comprises:

an amplifier for comparing said sense voltage to said reference voltage to generate an output current;

a charging path coupled to said amplifier and for charging an energy storage element with said output current to produce said compensation signal; and a comparator coupled to said charging path and for comparing said compensation signal to said ramp signal to generate said reset signal, wherein said charging path further comprises:

a first switch coupled to said feedback circuit and for alternating between cutting said charging path off and conducting said charging path based upon a control signal that is generated according to said reset signal and a pulse signal.

2. The circuit of claim 1, wherein said average current flowing through said LED light source is not functionally dependent on a circuit parameter selected from the group consisting of said input voltage, a condition of said LED light source and an inductor within said converter.

3. The circuit of claim 1, further comprising:

a second switch coupled to said sensor and for being switched on and off alternately based upon said driving signal, wherein said sensor senses said current flowing through said light source to provide said sense voltage when said second switch is on, and wherein no current flows through said sensor when said second switch is off.

4. The circuit of claim 3, further comprising:

a third switch coupled to said second switch and for passing said current from said LED light source to said second switch and coupled to said controller for providing a startup voltage to said controller.

5. The circuit of claim 1, wherein said controller further comprises:

a protection circuit for generating a protection signal based upon said sense voltage; and an output circuit coupled to said protection circuit and for generating said driving signal based upon said protection signal and said control signal.

6. The circuit of claim 1, wherein said converter comprises a second switch, and wherein said compensation signal is clamped to a non-zero level during an OFF state of said second switch.

7. A controller for controlling brightness of an LED light source, said controller comprising:

a first in for receiving a current flowing through said LED light source;

a second in for alternating between coupling to and decoupling from said first in based on a driving signal and for generating a sense voltage indicative of said current when said second in is coupled to said first pin, wherein a duty cycle of said driving signal determines an average current flowing through said LED light source;

a third pin for generating a compensation signal based upon a voltage difference between said sense voltage and a reference voltage indicative of a predetermined average current through said LED light source, wherein said duty cycle of said driving signal is adjusted base upon said compensation signal to adjust said average current to said predetermined average current;

a protection circuit coupled to said second pin and for generating a protection signal based upon said sense voltage; and an output circuit coupled to a flip-flop and said protection circuit and for generating said driving signal based upon said protection signal and said control signal.

8. The controller of claim 7, wherein said compensation signal is clamped to a non-zero value when said first pin is decoupled from said second pin.

9. The controller of claim 7, further comprising:

an amplifier coupled to said second pin and for receiving said sense voltage and for comparing said sense voltage to said reference voltage to provide an output current; and a charging path for passing said output current to an energy storage element coupled to said third pin to generate said compensation signal.

10. The controller of claim 7, further comprising:

an oscillator for generating a pulse signal;

a signal generator coupled to said oscillator and for generating a ramp signal;

a comparator coupled to said signal generator and for comparing said ramp signal to said compensation signal to generate a reset signal; and said flip-flop coupled to said oscillator and said comparator and for generating a control signal based upon said pulse signal and said reset signal.

11. The controller of claim 7, further comprising:

a fourth pin for receiving an enable signal to enable said controller;

a fifth pin for producing a constant DC voltage in response to said enable signal;

a sixth pin for receiving a startup voltage from a switch, wherein said switch is switched on by said constant DC voltage to produce said startup voltage and to pass said current flowing through said LED light source to said first pin.

12. A method comprising:

converting an input voltage to an output voltage across a light-emitting diode (LED) based upon a driving signal by a converter;

determining an average current through said LED light source by a duty cycle of said driving signal;

generating a sense voltage across a sensor which is selectively coupled to and decoupled from said converter based upon said driving signal, wherein said sense voltage is indicative of an LED current when said sensor is coupled to said converter;

comparing said sense voltage to a reference voltage indicative of a predetermined average current through said LED light source to generate an output current flowing through a charging path;

alternating a switch in said charging path between cutting said charging path off and conducting said charging path to charge an energy storage element with said output current;

generating a compensation signal according to a voltage across said energy storage element; and adjusting said duty cycle of said driving signal based upon said compensation signal to adjust said average current flowing through said LED light source to said predetermined average current.

13. The method of claim 12, further comprising:

switching a switch on and off alternately based upon said driving signal;

said LED current flowing through said sensor when said switch is on; and no current flowing through said sensor when said switch is off.

14. The method of claim 13, further comprising:

clamping said compensation signal to a non-zero value when said switch is off.

15. The method of claim 12, further comprising:

comparing said compensation signal to a ramp signal to provide a reset signal; and generating a control signal based upon a pulse signal and said reset signal.

* * * * *